United States Patent [19]

Brandt

[11] 4,238,653

[45] Dec. 9, 1980

[54] ELECTRICAL SWITCH HAVING A SETTING ROD ACTING AS A LEVER

[75] Inventor: Gert M. Brandt, Brønshøj, Denmark

[73] Assignee: Aktieselskabet MEC Makanisk Elektrisk Compagni af 1975, Ballerup, Denmark

[21] Appl. No.: 11,700

[22] Filed: Feb. 12, 1979

[30] Foreign Application Priority Data

Feb. 22, 1978 [DK] Denmark ..... 784/78

[51] Int. Cl.[3] ..... H01H 9/20

[52] U.S. Cl. ..... 200/153 J; 200/323

[58] Field of Search ..... 200/153 J, 321–328

[56] References Cited

U.S. PATENT DOCUMENTS

| | | | |
|---|---|---|---|
| 3,038,981 | 6/1962 | Larkin | 200/153 J |
| 3,375,340 | 3/1968 | Wright | 200/153 J X |
| 3,914,570 | 10/1975 | Lockard | 200/153 J |

FOREIGN PATENT DOCUMENTS

| | | | |
|---|---|---|---|
| 1223507 | 6/1960 | France | 200/153 J |

*Primary Examiner*—Stephen Marcus

*Attorney, Agent, or Firm*—LeBlanc, Nolan, Shur & Nies

[57] ABSTRACT

In an electrical switch including a housing and a button, which button, by means of a manual depression thereof in a single direction, is movable relative to the housing between two positions defined by a setting mechanism, and which mechanism comprises a setting rod one extreme end of which is guided by a slot or groove having two fixing points, the setting rod is embodied like an unequal-armed lever. The longest arm of the lever is allocated said two fixing points whereas the shortest arm is teetably supported in a through-hole of the button. The direction of the hole in the button is substantially perpendicular to the direction of movement of the button, and the rocking point of the lever or rod is situated in a housing wall. In comparison with prior art switches, the switch of the invention exhibits extremely reduced travel or stroke of the button.

2 Claims, 1 Drawing Figure

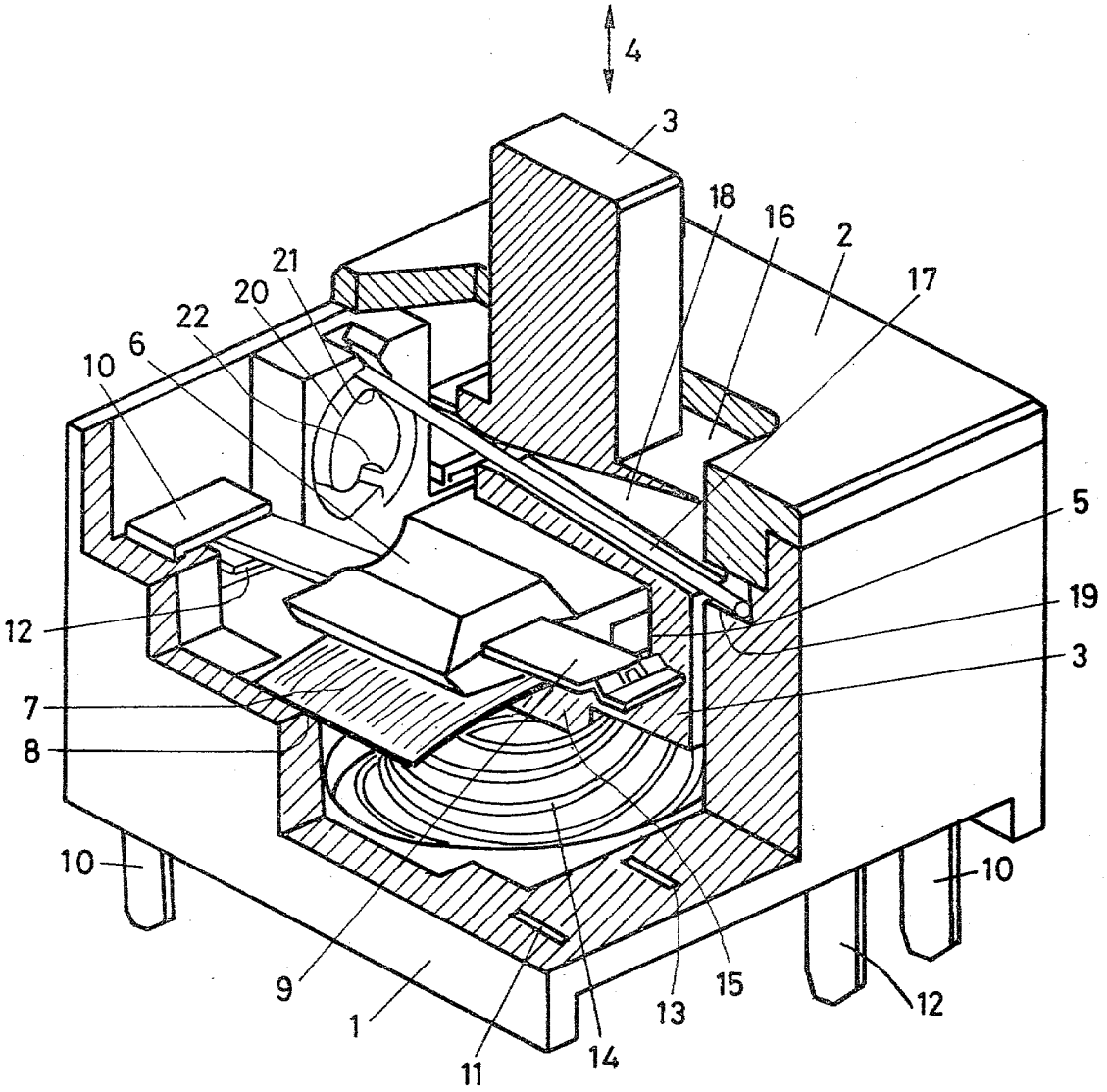
4
3
18
16
2
17
21
20
22
6
10
5
19
12
3
7
8
10
10
9
1
11
14
13
15
12

ELECTRICAL SWITCH HAVING A SETTING ROD ACTING AS A LEVER

The present invention is related to an electrical switch including a housing and a button, which button, by means of a manual depression thereof in a single direction, is movable relative to the housing between two positions being defined by a setting mechanism acting between the housing and the button, which mechanism comprises a setting rod, one end of which is guided by a slot or groove having two fixing points.

In a prior art switch of the kind mentioned above the fixing rod is substantially parallel with the direction of movement of the button and is, by means of a composing stick provided on one end of the rod, hanging in a bearing in the switch housing, whereas the other end of the rod is provided with an oppositely directed composing stick having two fixing positions in a heart-shaped slot or groove. The effect of this is that the travel or stroke of the button between its two positions is tied to be just as long as the distance between the two fixing positions of the heart-shaped slot or groove. Especially by applications in a modern, miniaturized electronic equipment a reduced travel or stroke of the button is desirable, but this has hitherto not been obtainable owing to the fact that the distance between the two fixing points of the heart-shaped curve could not in a convenient manner be reduced for the sake of the necessary wall thickness of the plastics material, in which the heart-shaped slot or groove has been provided.

It is an object of this invention to provide a switch having an extreme short travel or stroke of the button relative to the travel or stroke in prior art switches, for instance less than 2 mm. According to the invention this object is obtained by embodying the fixing rod in the manner of an unequal-armed lever, the longest arm of which is allocated two spaced-apart fixing points, the shortest arm of which is mounted and located in a through-hole in the button, the direction of the through-hole being substantially perpendicular to the direction of travel of the button, and the rocking movement of and takes place at the end of the rod which is the lever fulcrum common, to both lever arms and is located in a rocker bearing in the housing.

Thereby is obtained that the button travel or stroke is reduced from being equal to the distance between the two fixing points of the heart-shaped slot or groove to be equal to a fraction thereof, the fraction being equal to the ratio between the lengths of the lever arms, e.g. 1:2.

Such a lever may be an unequal-armed lever, the fulcrum end of which teeters or rocks on a bearing bracket secured to the housing, and the short arm of which is journalled in the button, whereas the long arm of which is guided by the heart-shaped curve, but according to a more advantageous embodiment of the present invention the rocker bearing is arranged in a side wall of the housing, whereas the two fixing points are provided by means of a heart-shaped slot or groove arranged in an opposite side wall of the housing, and where the rocker bearing of the button is situated between the extreme ends of the setting rod, preferably in the neighbourhood of its central part.

Thereby is obtained a much simpler construction and further, when the movement reduction is close to 2:1, that the setting rod engages the button near its central axis so that it is not induced to cant in its groove in the housing.

The present invention will now be described in detail below having reference to the drawing, which, partly in section and with some of the housing and its cover removed, illustrates in an axonometric view an embodiment of the electrical switch of the present invention.

Referring to the drawing reference numeral 1 designates the housing of the electrical switch, of which housing the corner nearest to the reader has been removed in order to visualize the parts of most importance to the invention. The housing is closed by means of a cover 2, the half of which nearest the reader has been removed on the drawing. A push button 3 is guided in the housing in such manner that it can perform small movements in directions indicated by a double arrow 4. The button is provided with a recess 5 in which a button bridge member 6 is placed. In said button bridge member is placed in a non-visible slot a flat spring 7, which is set up between two flat spring bearings on two opposite sidewalls of the housing 1. Of these flat spring bearings only one is visible on the drawing in position 8. Being non-biased the flat spring 7 is plane, but in position between the flat spring bearings 8 it can assume either the turned up position illustrated in the drawing or a turned down position not being shown on the drawing. By means of a depression of the button it will be able to change from either of said positions to the other one.

Inserted in the button bridge member 6 are two contact springs, of which only one 9 is visible on the drawing. The other contact spring is placed parallel with the visible one on the other side of the button 3. When the flat spring 7 is curved upwards, the contact springs 9 establish a connection between two pairs of contact pins 10, of which one has been removed from its associated aperture 11 in the housing 1. When the flat spring is curved downwards, then the contact springs no longer establish a connection between said two pairs of contact pins 10, but between two other pairs of contact pins 12, of which one is visible on the drawing. Another one of the last mentioned pins is disposed for insertion through an aperture 13 in the housing 1.

A coiled spring 14 is placed, while biased, between the bottom of the housing 1 and the button 3 and is secured by means of a post 15 underneath the button. This post 15 delimits the downwards movement of the button 3 by abutting the bottom of the housing 1, and the upwards movement of the button is delimited by a shoulder 16 on the button 3 abutting the inner surface of the cover 2.

A setting rod 17 is laid-in in a through-hole 18 provided in the button 3 in a direction substantially orthogonal to the direction of movement 4 of the button, and which through-hole constitutes the teeter bearing of the button for the rod 17, the fulcrum end. One end of the rod 17 is positioned in a bore 19 in the housing. The other end of the rod extends into a heart-shaped groove 20 provided in the side wall of the housing opposite the bore 19. The heart-shaped groove 20 forms in a well known manner an upper fixing point 21 and a lower fixing point 22 for the rod 17. Hence, the rod 17 constitutes a lever, the fulcrum end of which can toggle or teeter in the housing and the shortest arm of which extends from said end to the through-hole 18 in the button 3, and the longest arm of which extends from the fulcrum end to the opposite end of the rod positioned in the heart-shaped groove 20.

The electrical switch of the present invention operates as follows: If the button is in its upper position as illustrated, then the contact springs 9 establish a connection between either pair of contact pins 10. In this position the button is fixed by the setting rod 17 which, like a lever, is lifted to its upper position and there is maintained at the upper fixing point 21 of the heart-shaped groove. When depressing the button 3 the flat spring 7 will slip from the shown turned up position to a turned down position, which is accompanied by an audible click. During this movement the coiled spring 14 will be compressed and the contact springs 9 will disconnect the electrical connections between the contact pins 10 and alternatively establish electrical connections in pairs between the other contact pins 12. During this movement the shiftable end of the setting rod will move along the rear branch of the heart-shaped groove 20, and when the depression on the button discontinues the coiled spring 14 will elevate the button 3 so that the end of the setting rod 17 slips into the lower fixing point 22 of the heart-shaped groove 20, and owing to the heart shape of the groove the upwards pressure from the spring 14 on the button 3 will not be able to remove it from the assumed, lower position.

When the button again is depressed, e.g. by way of an operator's fingertip and assuming the electrical contact being in its lower position, the position of the setting rod in the lower fixing point 22 of the heart-shaped groove will be released and subsequently, when pressure from the operator's fingertip is removed, be guided along the foremost branch of the groove up to the upper fixing point 21.

When the setting rod 17 no longer fixes the button 3, the coiled spring 14 will shift the button upwards and during this action the coiled spring 14 will overcome the resistance from the downwards curved flat spring 7, which accompanied by an audible click will slip into its upwardly curved condition. Now, the described procedure may be repeated.

It will be acknowledged that by this arrangement the stroke of the button has been reduced relative to the distance between the fixing points 21 and 22 by a factor, which is equal to the ratio between the lengths of the long and the short leverarm, respectively.

As a matter of course it will be acknowledged that many other embodiments of the electrical switch of the present invention than that which has been described and illustrated may be manufactured without departing from the scope of the invention. Thus, it will be possible to let the end of the setting rod be secured in a body member, which on its side facing the wall of the housing carries the heart-shaped groove, provided that a guide pin is embedded in the inner wall of the housing, which pin engages the heart-shaped groove. Further, it will be noted that the bearing through-hole 18 in the button as is illustrated has a convergence to a reduction location, which constitutes the true teeter bearing, and that it is displaced laterally of the central part of the button. By displacing the teeter bearing towards the wall of the housing provided with bore 19, the leverarm-ratio may be changed within wide limits giving the possibility of obtaining a particular, demanded stroke of the button. Properly speaking, fixing points need not be provided by means of the heart-shaped groove, but alternatively, one may employ fixing points provided in another way, for instance by the aid of a toggle member pivotally mounted on a horizontal axle embedded in the wall of the housing, the member constituting the bearing of the the movable end of the setting rod, it only being necessary that the function of the setting rod as a lever is maintained.

I claim:

1. An electrical switch including a housing and a button having a through hole therein, which button, by means of a manual depression thereof in a single direction, is movable relative to said housing between two positions defined by a setting mechanism acting between said housing and said button, said setting mechanism including a setting rod with two ends, one extreme end of which is guided in a slot or groove having two fixing points, characterized in that said setting rod comprises an unequal-armed lever with its fulcrum at the second end of said rod, the longest arm of said lever terminating at said extreme end of said rod and being allocated said two spaced-apart fixing points, the shortest arm of said lever being rockably supported in said through-hole of said button, the direction of said through-hole being substantially perpendicular to the direction of movement of said button, and means in said housing maintaining the fulcrum end of said lever as a substantially fixed rocking point of said lever in said housing.

2. An electrical switch according to claim 1, characterized in that said means maintaining said fulcrum end at said substantially fixed rocking point is a rocker bearing disposed in said housing in one if its side walls, said two fixing points are provided by means of heart-shaped groove means provided in an opposite sidewall of the housing, and a teeter portion of said botton is disposed on the wall of said through-hole and situated between the two ends of said setting rod adjacent the central part of said rod.

* * * * *